United States Patent [19]

Masui

[11] 4,447,042

[45] May 8, 1984

[54] VEHICLE LIFT

[75] Inventor: Saburo Masui, Tokyo, Japan

[73] Assignee: Yasui Sangyo Co., Ltd., Fujinomiya, Japan

[21] Appl. No.: 300,681

[22] Filed: Sep. 9, 1981

[30] Foreign Application Priority Data

Apr. 6, 1981 [JP] Japan ..... 56-51564

[51] Int. Cl.[3] ..... B66F 3/22

[52] U.S. Cl. ..... 254/90; 254/122; 254/124; 187/8.43; 187/8.71

[58] Field of Search ..... 254/90, 122, 124, 9 C, 254/10 C, 1; 187/8.43, 8.71, 8.72, 8.47, 8.41; 33/203.14, 203.12; 92/15, 23, 25, 30

[56] References Cited

U.S. PATENT DOCUMENTS

| | | | |
|---|---|---|---|
| 2,025,051 | 12/1935 | Haucke | 33/203.12 |
| 3,759,488 | 9/1973 | Lukas | 254/8 R |
| 3,865,214 | 2/1975 | Clark et al. | 187/8.72 |
| 3,991,857 | 11/1976 | Wolk et al. | 254/122 |
| 4,039,093 | 8/1977 | Schmitz et al. | 92/23 |
| 4,212,374 | 7/1980 | Bubik | 187/8.43 |

*Primary Examiner*—Robert C. Watson

*Attorney, Agent, or Firm*—Lackenbach, Siegel, Marzullo, Presta & Aronson

[57] ABSTRACT

A vehicle lift having a platform mounted on a base for supporting a vehicle, and having a first link which moves the platform up and down. A table is mounted to the platform and supports the chassis of the vehicle by moving the table up and down by a second link. The table may be movably mounted to the platform and a safety device may be provided for preventing the platform from a sudden fall.

7 Claims, 8 Drawing Figures

VEHICLE LIFT

BACKGROUND OF THE INVENTION

This invention relates to a lift for lifting a vehicle when the underside of the vehicle is to be viewed such as when inspected, repaired and washed.

In a conventional two-pillar or four-pillar vehicle lift, a vehicle is lifted by lifting and supporting its wheels or chassis by means of lifting means. However, in this case, the pillars obstruct access to certain parts of the vehicle when the vehicle is inspected or repaired. Further, this kind of vehicle lift occupies a wide area of installation.

Further, in a vehicle with four wheel independent suspensions, the rear wheels of the vehicle are, in many cases, provided with the camber and the toe-in, and the adjustment of the alignment of the rear suspensions is required. In such a case, foot plates may be movable in the right and left directions so as to perform an exact measurement.

SUMMARY OF THE INVENTION

It is an object of the present invention to provide a vehicle lift free from the aforementioned inconveniences, which is simple and reliable and which can support either the wheels or the chassis of the vehicle when it is inspected and repaired.

According to the present invention there is provided a vehicle lift comprising (a) a base, (b) a platform, mounted on the base, on which a vehicle is driven onto, (c) a first link which moves the platform up and down, (d) a table for supporting the chassis of the vehicle, mounted to the platform, and (e) a second link which moves the table up and down.

BRIEF DESCRIPTION OF DRAWINGS

In order that the present invention may be better understood, a preferred embodiment thereof will be described with reference to the accompanying drawings, in which.

DESCRIPTION OF A PREFERRED EMBODIMENT

Figure 1:
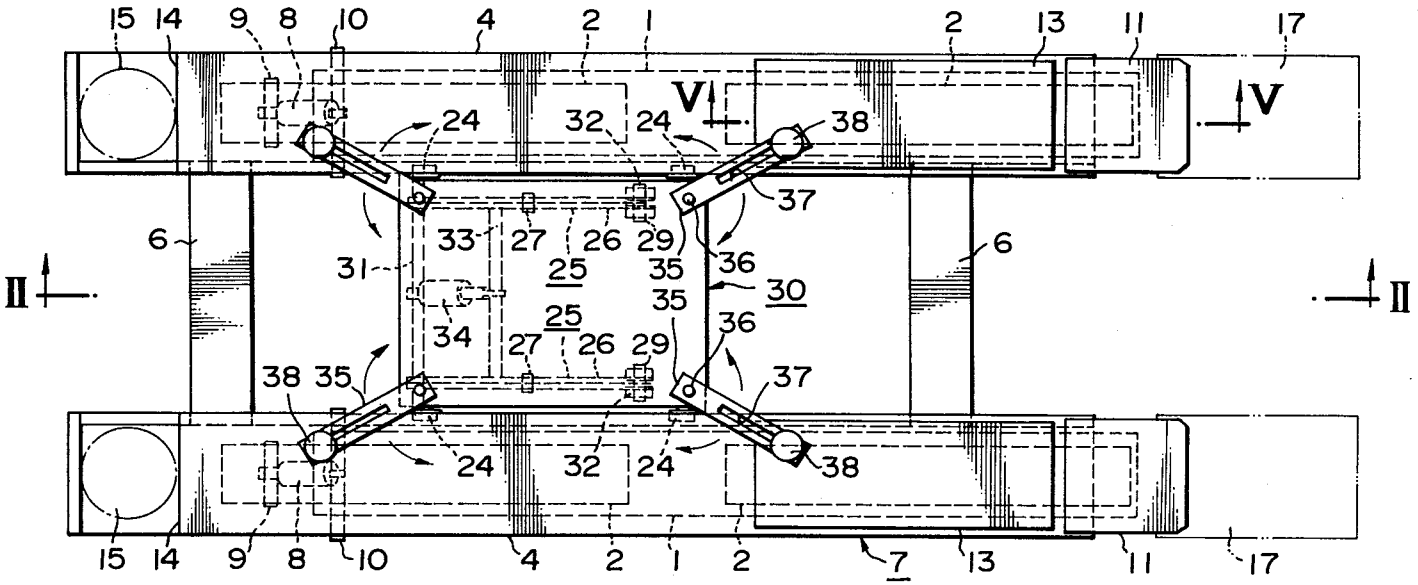
FIG. 1 is an elevational view of one embodiment of a vehicle lift according to the present invention.

Referring to the drawings there is shown in FIGS. 1-4 a vehicle lift according to the present invention.

A pair of base members 1 having a U-shaped cross-section are arranged in parallel with each other at a certain distance away from one another. One of the ends of two pairs of pivot members 2, one being parallel with the other, are pivotally mounted to the base members 1 at their front end and center portions via pivot pins 3. The other ends of the pivot members 2 are pivotally mounted to a pair of wheel support members 4 which have an upset U-shaped cross-section and are parallel with the base members 1, in their central and rear portions via pivot pins 5. Hence, the base members 1, the pivot members 2 and the wheel support members 4 constitute parallelogram links.

The wheel support members 4 are connected to each other by coupling plates 6 in their front and rear portions, thereby forming a rectangular frame-like platform 7 on which the vehicle rests.

Both ends of a pair of hydraulic cylinder means 8 are pivotally mounted to the other end portion of the rear pivot members 2 and the front vicinities of the rear pivot connections of the wheel support members 4 via pivot pins 9 and 10, so that the platform 7 may be moved up and down by the expanding and the contracting motions of the hydraulic cylinder means 8 while the platform 7 is maintained horizontal.

Figure 3:
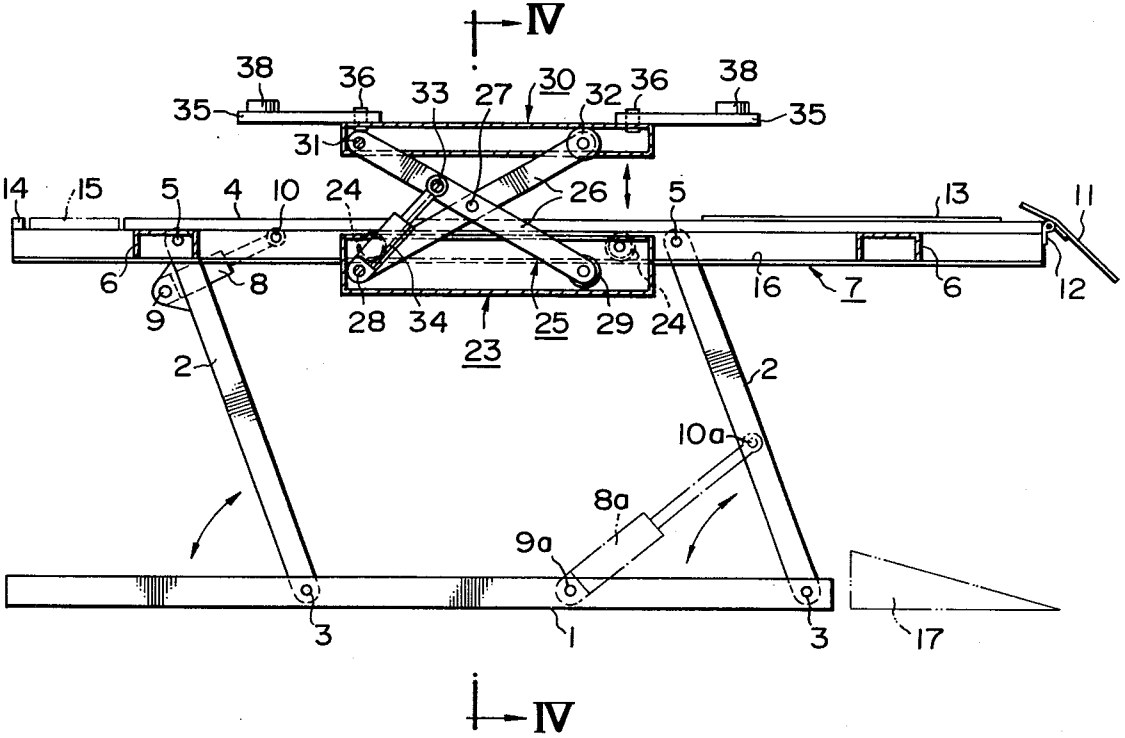
FIG. 3 is a central longitudinal cross-section of a vehicle lift according to the present invention, wherein a platform and a table are lifted.
Figure 4:
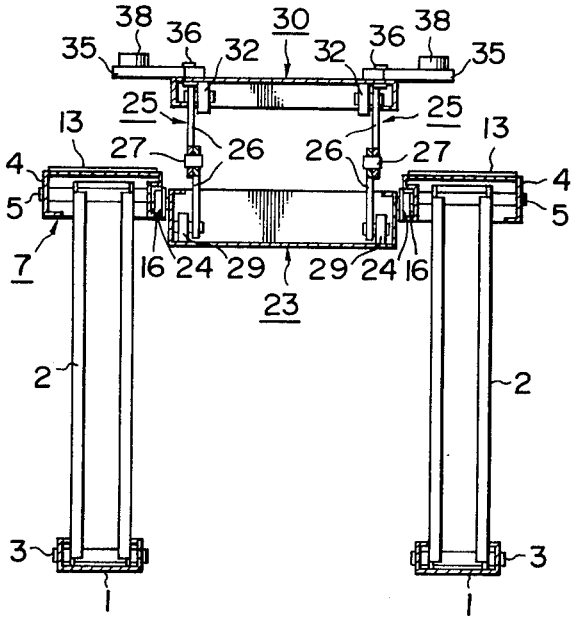
FIG. 4 is a longitudinal cross-section, taken along the line IV—IV of FIG. 3.

Usually, both ends of hydraulic cylinder means **8*a* are pivotally mounted to the front portions of the base members 1 and the one end portions of the front pivot members 2 via pivot pins 9*a* and 10*a***, as shown by the two-dotted lines in FIG. 3. However, this position is rather inconvenient for the operator.

A ride-on plate 11 is pivotally mounted to the front end of each wheel support member 4 in its lower rear portion through a hinge 12. A foot plate 13 which is hereinafter described in detail, is mounted onto the upper front portion of each wheel support member 4. The wheel support member 4 is provided with a groove 14 in its rear end portion, in which a turning radius gauge 15 is attached.

On the inner sides of each wheel support members 4 a guide groove 16 is cut out extending horizontally along its entire length.

Figure 2:
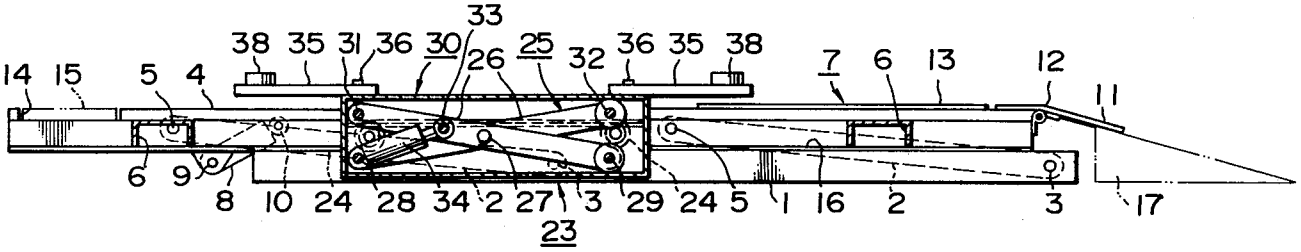
FIG. 2 is a longitudinal cross-section, taken along the line II—II of FIG. 1.

When the platform 7 is lowered, as shown in FIG. 2, the wheel support members 4 rest over the base members 1, and the front parts of the ride-on plates 11 rest over the rear parts of ride-on blocks 17, each block 17 having a rectangular longitudinal cross section, which rests on the floor in front of the base members 1.

When the platform 7 is raised, as shown in FIG. 3, the ride-on plates 11 pivot lowering down their front parts, and thus their rear parts are raised and become wheel stops for the vehicle on the platform 7.

Figure 5:
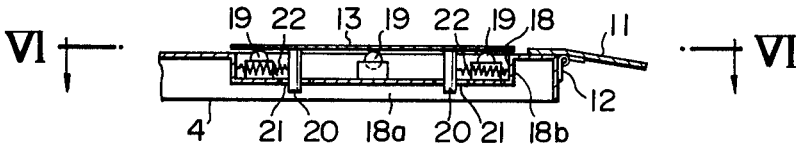
FIG. 5 is a fragmentary longitudinal cross-section, taken along the line V—V of FIG. 1.
Figure 6:
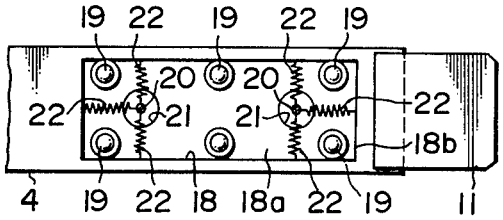
FIG. 6 is a transverse cross-section, taken along the line VI—VI of FIG. 5.

As shown in FIGS. 5 and 6, the foot plate 13 is supported movably in the front, the rear, the right and the left directions by balls 19 which are arranged in a recess box 18 formed in the upper front portion of the wheel support member 4.

Two vertical rods 20 are positioned at a certain distance away from each other along the central axis of the foot plate 13, and extend downwardly from the front plate 13 through wide holes 21 opened in a bottom plate **18*a* of the recess box 18. A plurality of extension springs 22 are so extended from the vertical rods 20 to side plates 18*b* of the recess box 18 such that they may be balanced so as to place the vertical rods 20 normally in the centers of the respective wide holes 21 of the recess box 18**.

An open-top box-type chassis 23 is provided with rollers 24 on its sides, and the rollers 24 roll in the guide grooves 16 of the wheel support members 4. Accordingly, the chassis 23 is movably hung on the wheel support members 4 therebetween via the rollers 24, and can be moved frontwards or rearwards by driving the rolls 24 by a drive motor (not shown).

A pair of right and left X-shaped links 25 comprises pairs of link members 26, each pair of which is pivotally connected to each other at their centers in the X-shape by link pins 27. The rear ends of the right and the left links 25 are pivotally mounted to the rear end of the chassis 23 via a pivot shaft 28 extending horizontally in the direction of the right and the left direction. In the front lower outer ends of the right and the left links 25, right and left rollers 29 are pivotally mounted and can roll on the floor of the chassis 23.

The rear upper ends of the links 25 are pivotally mounted to the rear end of an open-bottom box-like table 30 via a pivot shaft 31 extending in the same direction as the shaft 28. In the front upper inner ends of the links 25, right and left rollers 32 are pivotally mounted, and the front part of the table 30 rests on the rollers 32.

The right and the left link members 26 which extend in a rear upper diagonal direction, are coupled by a coupling rod 33 between the link pins 27 and the pivot shaft 31. A hydraulic cylinder means 34 is positioned to and between the pivot shaft 28 and the coupling rod 33. Hence, the table 30 is moved up and down by expanding and contracting the hydraulic cylinder means 34 while it is kept in a horizontal position.

Four support arms 35 are pivotally mounted to the upper four corners of the table 30 via vertical pins 36 (the support arms 35 extend in outer radial directions). Each support arm 35 is provided with a vertical slot 37 along its extending direction, and a receiver member 38 is slidably mounted to the support arm 35 along the slot 37.

The vehicle lift described operates as follows. The platform 7 and the table 30 are lowered to the lowermost positions, and the support arms 35 are pivoted to the proper positions. Then, the vehicle is driven up onto the wheel support members 4 until the rear wheels of the vehicle are positioned on the foot plates 13.

Since the foot plates 13 are movable in the front, the rear, the right and the left directions, as described above, when the adjustment of the alignment of the rear suspensions are necessary, or the vehicle faces a slanting direction, or the front and the rear positions of the vehicle is to be slightly adjusted, the vehicle is readily moved with one's handling it by hands.

In this state, the steering angle of the front wheels, the camber, the caster, and the like, can be measured by using the turning radius gauge 15.

Then, the vehicle is raised to the desired height by pivoting the pivot members 2 by use of the hydraulic cylinder means 8, as described above.

Further, the table 30 is properly moved forwards or rearwards, the support arms 35 are pivoted to the proper directions, and the receiver members 38 on the support arms 35 are moved to the proper positions under the chassis of the vehicle. Then, the table 30 is lifted via the X-shaped links 25 by actuating the hydraulic cylinder means 34, thereby lifting and separating the wheels of the vehicle off the platform 7. In this state, the change of tires, the adjustment of the brake, and the like, can conveniently be carried out.

According to the present invention, of course, the platform 7 may be moved up and down by X-shaped links which are similar to those for the table 30, and the table 30 may be moved up and down by parallelogram links which are similar than those for the platform 7.

Figure 7:
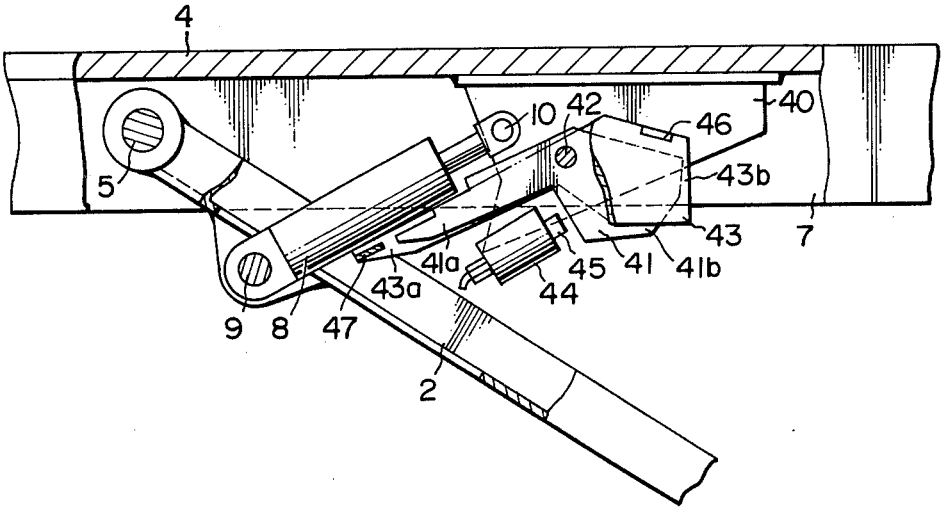
FIG. 7 is fragmentary longitudinal cross-section of a safety device showing the hydraulic piston prior to extension.
Figure 8:
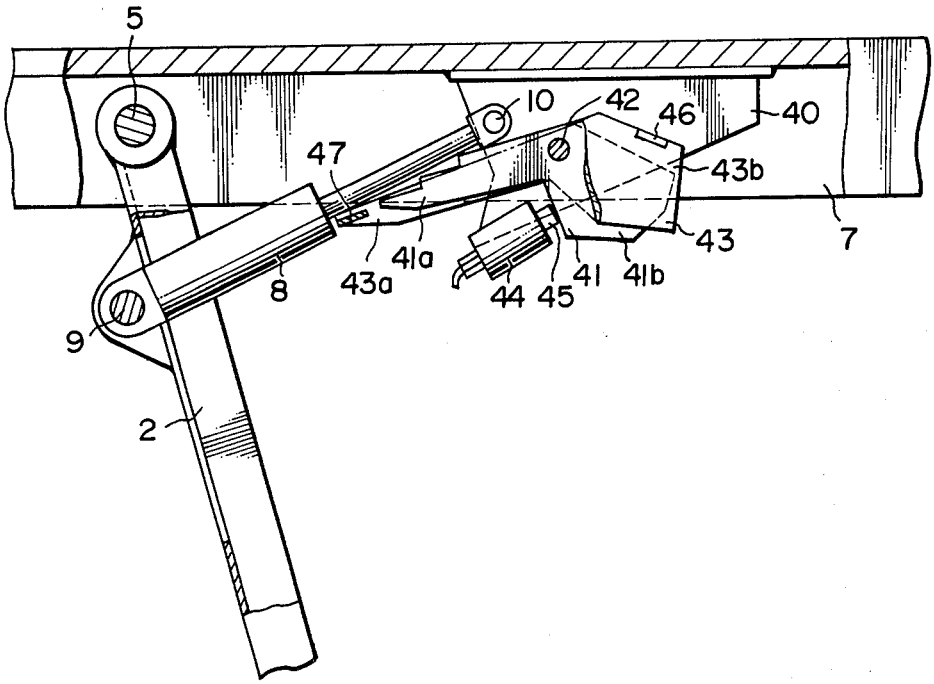
FIG. 8 is a fragmentary longitudinal cross-section of a safety device showing the hydraulic piston in an external position.

In FIGS. 7 and 8, there is shown a safety device for lowering the wheel support members 4, which prevents the wheel support members 4 from a sudden fall by stopping the contracting action of the hydraulic cylinder means 8.

A pair of brackets 40 (only one is shown) are mounted to the wheel support member 4. In this case, the free end of the piston of the hydraulic cylinder means 8 is pivotally mounted to the brackets 40 via the pivot pin 10. A first lock plate 41 is pivotally mounted to the brackets 40 therebetween through a pivot shaft 42 and comprises a lock step part **41*a* and a weight part 41*b*, both being positioned on opposite sides with respect to the pivot shaft 42** and the latter being heavier than the former.

A pair of second lock plates 43 are pivotally mounted onto the pivot shaft 42 on the both sides of the first lock plate 41 between the brackets 40. Each second lock plate 43 comprises a lock part **43*a* and a weight part 43*b*, both being positioned on opposite sides with respect to the pivot shaft 42** and the latter being heavier than the former.

The upper ends of the weight parts **43*b* of the second lock plates 43 are connected to each other by a coupling bar 46 and the free ends of the lock parts 43*a* of the second lock plates 43 are connected to each other by a connection plate 47**.

A cylinder 44, having a piston rod 45 which is expanded by actuating the cylinder 44, is secured to the bracket 40 so that the piston rod 45 may push the lower side of the weight part **41*b* of the first lock plate 41** in the counterclockwise direction.

When the wheel support members 4 are being lifted, as shown in FIG. 7, the piston rod 45 of the cylinder 44 is contracted, and the lock step part **41*a* of the first lock plate 41 and the lock parts 43*a* of the second lock plates 43 are contacted with the cylinder side of the hydraulic cylinder means 8 by the weights of the weights parts 41*b* and 43*b* of the first and the second lock plates 41 and 43**.

Then, as the hydraulic cylinder means 8 is expanded, the lock step part **41*a* of the first lock plate 41 is pivoted stepwise in contact with the cylinder of the hydraulic cylinder means 8. When the end of the cylinder of the hydraulic cylinder means 8 is passed through the free end of the lock step part 41*a* of the first lock plate 41, the first lock plate 41 is pivoted clockwise until the lower side of the weight part 41*b* of the first lock plate 41 is butted against the free end of the piston rod 45. However, on this occasion, the free ends of the lock parts 43*a* of the second lock plates 43 are still contacted by the cylinder side of the hydraulic cylinder means 8**.

When the hydraulic cylinder means 8 is further expanded passing through the free ends of the lock parts **43*a* of the second lock plates 43, the second lock plates 43 are pivoted clockwise with the result that the free ends of the lock parts 43*a* of the second lock plates 43 engage with the cylinder end of the hydraulic cylinder means 8, as shown in FIG. 8**.

Therefore, in this state, even if the hydraulic cylinder means 8 is suddenly contracted as could happen in an accident or the like, the cylinder end thereof is locked by the free end of the lock parts **43*a* of the second lock plates 43 and thus the wheel support members 4 are prevented from the falling. In the course of the lift of the wheel support members 4, even when the hydraulic cylinder means 8 is suddenly contracted, the cylinder end thereof is locked by one of the steps of the lock step part 41***a* of the first lock plate 41 and accordingly the wheel support members 4 are prevented from falling to the bottom.

In order to release the lock of the lock parts 43*a* of the second lock plates 43 and the lock step part 41*a* of the first lock plate 41 with the cylinder means 8, the cylinder 44 is actuated to push the weight part 41*b* of the first lock plate 41 in the counterclockwise direction, and then the upper end of the weight part 41*b* of the first lock plate 41 is butted to the coupling bar 46, thereby pivoting the second lock plates 43 counterclockwise to release the lock of the free end of the lock parts 43*a* thereof from the cylinder end of the hydraulic cylinder means 8.

Although the present invention has been described with reference to a preferred embodiment thereof, however, various changes and modifications can be made by those skilled in the art without departing from the scope of the present invention.

What is claimed is:

1. A vehicle lift comprising:

(a) a base;

(b) a platform, mounted on the base, on which a vehicle is driven up upon; said platform having a pair of foot plates which are movable in a horizontal plane;

(c) a first link which moves the platform up and down;

(d) a table for supporting a chassis of the vehicle movably mounted to the platform;

(e) a second link which moves the table up and down independent of the movement of said platform by said first link; and (f) said table being movably mounted to the platform through a chassis provided with rollers guided by guide grooves in wheel support members, and said chassis is adapted to move forward and rearward along the platform by being suspended from said wheel support members.

2. A lift as defined in claim 1, wherein said pair of foot plates have the same height as that of the platform, and the rear wheels of a vehicle are positioned horizontally on said foot plates.

3. A lift as defined in claims 1 or 2, wherein one of the first and the second links comprises a parallelogram link and the other comprises a X-shaped link.

4. A lift as defined in claims 1 or 2, wherein the first and the second links comprise parallelogram links.

5. A lift as defined in claims 1 or 2, wherein the first and the second links comprise X-shaped links.

6. A lift as defined in claims 1 or 2, wherein said first link comprises link members, one of the ends of which are pivotally connected to the base and the other of the ends of which are pivotally connected to the platform, and wherein hydraulic cylinder means are arranged in the connection portions of the link members and the platform.

7. A lift as defined in claim 6, wherein the platform is provided with a safety device having lock means with lock steps, which prevent the platform from a sudden fall by engaging the cylinders of the hydraulic cylinder means with the lock steps of the lock means, and wherein the locks of the cylinders of the hydraulic cylinder means with the lock steps of the lock means are released by cylinder means when the platform is lowered.

* * * * *